US009874022B2

(12) United States Patent
Hull et al.

(10) Patent No.: US 9,874,022 B2
(45) Date of Patent: Jan. 23, 2018

(54) MOLDABLE ROOF FLASHING

(71) Applicant: Oatey Co., Cleveland, OH (US)

(72) Inventors: Eric G. Hull, Avon Lake, OH (US); Willie Perez, Hudson, OH (US)

(73) Assignee: OATEY CO., Cleveland, OH (US)

( * ) Notice: Subject to any disclaimer, the term of this patent is extended or adjusted under 35 U.S.C. 154(b) by 0 days.

(21) Appl. No.: 14/666,415

(22) Filed: Mar. 24, 2015

(65) Prior Publication Data

US 2015/0267413 A1 Sep. 24, 2015

Related U.S. Application Data

(60) Provisional application No. 61/969,535, filed on Mar. 24, 2014.

(51) Int. Cl.
*E04D 1/36* (2006.01)
*E04D 13/147* (2006.01)
*E04D 13/04* (2006.01)

(52) U.S. Cl.
CPC ..... *E04D 13/1476* (2013.01); *E04D 13/0481* (2013.01); *E04D 2013/0486* (2013.01)

(58) Field of Classification Search
CPC ..... E04D 13/1476; E04D 13/0481; E04D 2013/0486
USPC ..... 52/58, 60, 219
See application file for complete search history.

(56) References Cited

U.S. PATENT DOCUMENTS 3,297,461 A * 1/1967 Siddall ..... 428/136
3,932,249 A * 1/1976 Jury et al. ..... 156/213
3,977,137 A * 8/1976 Patry ..... E04D 13/1407 285/42
4,333,660 A * 6/1982 Cupit ..... 277/630
4,512,119 A * 4/1985 Willoughby ..... E04D 13/1476 285/43
4,664,390 A * 5/1987 Houseman ..... 277/606
5,072,552 A * 12/1991 Sauder ..... E04D 13/1407 52/219
5,414,964 A * 5/1995 Bodycomb ..... 52/58
5,426,898 A * 6/1995 Larsen ..... 52/58
6,185,885 B1 * 2/2001 Thaler ..... E04D 13/1407 285/42
6,244,006 B1 * 6/2001 Shue ..... E04D 13/147 52/302.1
6,279,272 B1 * 8/2001 Nill, Jr. ..... 52/58
6,581,045 B1 * 6/2003 Watson ..... G06Q 10/06 705/400
7,971,403 B2 * 7/2011 Meier ..... 52/411
8,132,390 B2 * 3/2012 Van Schellebeek ..... 52/746.11
2004/0025462 A1 * 2/2004 Meier ..... 52/412
(Continued)

FOREIGN PATENT DOCUMENTS

EP 0123141 10/1984
GB 2184685 A 7/1987

*Primary Examiner* — Basil Katcheves
*Assistant Examiner* — Joshua Ihezie
(74) *Attorney, Agent, or Firm* — Baker & Hostetler LLP

(57) ABSTRACT

A roof flashing and a combination of the roof flashing, a roof structure, and a conduit are provided. The roof flashing includes a base and a flexible tube. Both the base and the flexible tube include an elastic water barrier and a plastically deformable shaping material, allowing the base to be molded to the contours of the roof structure and the tube to be shaped to closely fit around the conduit.

19 Claims, 5 Drawing Sheets

(56) References Cited

U.S. PATENT DOCUMENTS

| | | | | |
|---|---|---|---|---|
| 2005/0028456 | A1* | 2/2005 | McLane | E04D 13/1407 52/58 |
| 2005/0055889 | A1* | 3/2005 | Thaler | 52/58 |
| 2005/0204648 | A1* | 9/2005 | Bibaud et al. | 52/58 |
| 2007/0101664 | A1* | 5/2007 | Hoy et al. | 52/198 |
| 2009/0118688 | A1* | 5/2009 | Nielsen et al. | 604/349 |
| 2010/0109318 | A1* | 5/2010 | Mulligan | E04D 13/0409 285/42 |
| 2013/0020796 | A1* | 1/2013 | Humber | 285/44 |
| 2013/0135744 | A1* | 5/2013 | Jaster | 359/597 |
| 2014/0021713 | A1* | 1/2014 | DeGraan | 285/42 |

* cited by examiner

MOLDABLE ROOF FLASHING

CROSS-REFERENCE TO RELATED APPLICATIONS

This application claims the benefit of U.S. Provisional Application Ser. No. 61/969,535, filed Mar. 24, 2014, the entire contents of which is incorporated herein by reference.

FIELD OF THE INVENTION

The present application relates generally to a roof flashing for sealing a conduit protruding from the roof of a building.

BACKGROUND

Roof flashings are used to seal openings around conduits extending through the roofs of buildings. Various types of roof flashings are well known. Generally, roof flashings can be shaped to conform to the contour of the roof to create a water-tight seal between the flashing, the conduit, and the roof. To facilitate being conformed to the shape of the roof, roof flashings are typically made from a thin sheet of a malleable metal such as lead, aluminum, or copper.

Lead flashing has been in the market since 1916, and is still used in many areas in the U.S. Lead flashing represents approximately 15% of the total flashing market and is a preferred solution in certain markets due to its ductility and its ability to withstand the environmental elements

SUMMARY

The present application discloses exemplary embodiments of a roof flashing, a roof flashing in combination with a roof structure and a conduit, and a method of installing a roof flashing. By way of example to illustrate various aspects of the general inventive concepts, several exemplary embodiments of compositions and methods are disclosed herein.

A roof flashing embodying the principles of the invention is a lead-free alternative to traditional lead flashing. In the roof flashing embodying the principles of the invention, plastically deformable shaping material is attached to a water barrier made from an elastically deformable material. The water barrier provides a water impervious barrier between the roof flashing and the surface of a roof structure and conduit. The shaping material allows the roof flashing to maintain its shape after being formed to match the contours of the roof structure and conduit.

In an exemplary embodiment, the present disclosure is directed to a roof flashing comprising: a base, a flexible tube, and an opening through the base. The base includes a first water barrier attached to a first metallic shaping material. The first water barrier is made from a first elastomer. The base is shapeable to match the contour of a roof structure. The flexible tube includes a second water barrier over-molded onto a second metallic shaping material. The second water barrier is made from a second elastomer. The flexible tube conforms to a conduit extending from the roof structure. The flexible tube is foldable over an upper end of the conduit providing a seal. The flexible tube extends through the opening in the base.

In an exemplary embodiment, the present disclosure is directed to a roof flashing in combination with a roof structure and a conduit extending from the roof structure. The roof flashing comprises a base, a flexible tube, and an opening through the base. The base includes a first water barrier over-molded onto a first metallic shaping material. The first water barrier is made from a first elastomer. The base is shapeable to match the contour of the roof structure. The flexible tube includes a second water barrier over-molded onto a second metallic shaping material. The second water barrier is made from a second elastomer. The flexible tube conforms to the conduit extending from the roof structure. The flexible tube is foldable over an upper end of the conduit providing a seal. The flexible tube extends through the opening in the base.

A method of installing a roof flashing comprising: over-molding a first water barrier made from a first elastomer onto a first metallic shaping material to form a base; over-molding a second water barrier made from a second elastomer onto a second metallic shaping material to form a flexible tube. The method further comprises extending the flexible tube through an opening in the base and shaping the base to match the contour of a roof structure. Additionally, the method includes conforming the flexible tube to a conduit extending from the roof structure and folding the flexible tube over an upper end of the conduit to provide a seal.

Materials for the water barrier and shaping material can be selected with the function of each element in mind, rather than relying on a single material to perform both the sealing and shaping functions. Thus, a material better suited for sealing against water can be selected for the water barrier, while a material better suited for molding and shaping the roof flashing can be selected for the shaping material. If desired, particular embodiments may optionally allow for the shaping material to be embedded within the water barrier, such that the roof flashing appears to be made from a single material. In one such embodiment, a rubber water barrier may contain a shaping material comprising metal strips arranged parallel to each other or in a mesh pattern.

DETAILED DESCRIPTION

The present application discloses a moldable roof flashing and a combination of a moldable roof flashing, a roof structure, and a conduit protruding from the roof structure. As used herein the term "lead-free" refers to an item having a weighted average of not more than 8% lead, including not more than 0.25% lead.

Figure 1:
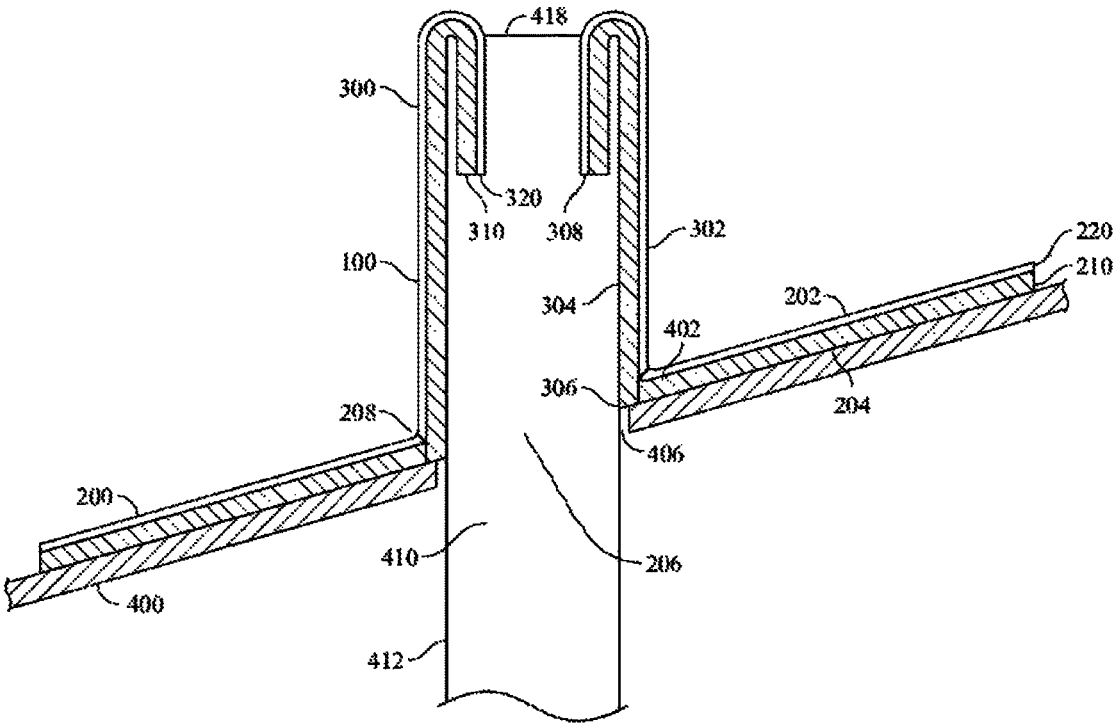
FIG. 1 is a cutaway illustration of an exemplary roof flashing installed on a roof structure and shaped around a conduit protruding through the roof structure.

Referring to FIG. 1, a cutaway drawing of an exemplary embodiment of a roof flashing 100 is shown installed on a roof structure 400 and formed to closely fit around a conduit 410 protruding through an opening 406 in the roof structure 400. The moldable roof flashing 100 includes a base 200 and a flexible tube 300.

The base 200 has a top surface 202 that is exposed to the elements and a bottom surface 204 that is pressed against the top surface 402 of the roof structure 400. The base 200 is comprised of a water barrier 210 that is attached to a shaping material 220. Alternatively, in certain embodiments the shaping material 220 may be interposed between the water barrier 210. The water barrier 210 covers the bottom surface 204 of the base 200, and in certain embodiments, may cover the top surface 202 of the base 200 as well.

The flexible tube 300 has an outer surface 302 that is exposed to the elements, and an inner surface 304 that is oriented toward the conduit 410. The flexible tube 300 is comprised of a water barrier 310 that is attached to a shaping material 320. Alternatively, in certain embodiments the shaping material 320 may be interposed between the water barrier 310. The water barrier 310 covers the inner surface 304 of the flexible tube 300, and in certain embodiments, may cover the outer surface 302 of the flexible tube 300 as well. The flexible tube 300 extends from a lower end 306 to an upper end 308, and may have any cross-sectional shape that is suitable to accommodate the conduit 410.

An opening 206 in the base 200 allows the flexible tube 300 to extend through the base 200. The opening 206 is roughly the same shape and size as a cross-section of the flexible tube 300. The flexible tube 300 has an upper end 308 that is above the base 200 and a lower end 306 that aligns with, or optionally extends below, the bottom surface 204 of the base 200. A joint 208 sealingly connects the flexible tube 300 to the base 200 where they intersect.

The water barrier 210 in the base 200 and the water barrier 310 in the flexible tube 300 may be formed of any suitable material. Examples of suitable materials include, but are not limited to, silicone or silicone rubber, fluorinated silicone or silicone rubber, polysiloxanes, polydimethylsiloxanes, plasticized PVC, EPDM, Viton, rubber materials, plastic materials, thermoplastic elastomers, or any other elastically deformable and water repellant material. In certain embodiments, the water barrier 210 in the base 200 and the water barrier 310 in the flexible tube 300 are formed of the same material. In certain other embodiments, the water barrier 210 in the base 200 and the water barrier 310 in the flexible tube 300 are formed of different materials.

The shaping material 220 in the base 200 may be formed of any suitable material. Examples of suitable materials include, but are not limited to, aluminum, copper, galvanized steel, other metal or metallic materials, plastic or plastically deformable materials, or any other deformable material, including stainless steel, zinc alloy, lead-coated copper, anodized aluminum, terne-coated copper, galvalume (aluminum-zinc alloy coated sheet steel), polyvinylidene fluoride (sometimes known as kylar or hylar), and metals similar to stone-coated metal roofing. In certain embodiments, the shaping material 220 in the base 200 and the shaping material 320 in the flexible tube 300 are formed of the same material. In certain other embodiments, the shaping material 220 in the base 200 and the shaping material 320 in the flexible tube 300 are formed of different materials.

In certain embodiments, the shaping material 220 in the base 200 is formed of a plurality of metal strips. The arrangement of these metal strips may be adjusted to vary the stiffness of the shaping material 220 in the base 200. For example, the spacing between the strips can be increased to decrease the stiffness of the shaping material 220, or the metal strips can be arranged in a mesh pattern to increase the stiffness of the base 200. The arrangement of the metal strips can also be changed to vary the stiffness of the shaping material 220 depending on the direction in which the base 200 is bent.

Likewise, in certain embodiments, the shaping material 320 in the flexible tube 320 is formed of a plurality of metal strips. The arrangement of these metal strips may be adjusted to vary the stiffness of the shaping material 320 in the flexible tube 300. For example, the spacing between the strips can be increased to decrease the stiffness of the shaping material 320, or the metal strips can be arranged in a mesh pattern to increase the stiffness of the flexible tube 300.

The roof structure 400 may be any roof structure and may comprise many layers of various materials, such as wood, metal, and/or ceramic. The top surface 402 of the roof structure 400 may be covered in shingles or tiles, or any other roofing material. The base 200 is molded to conform to the contours of the top surface 402 of the roof structure 400. The water barrier 210 on the bottom surface 204 of the base 200 prevents water from entering the opening 406 in the roof structure 400 as it flows down the roof structure 400 and is diverted into a drainage system.

The conduit 410 may be any pipe, tube or comparable structure suitable, whether cylindrical, non-cylindrical, for transporting a fluid, including without limitation, liquids, slurries, and gases. The conduit 410 may also be any conduit or passageway that passes through the roof structure 400 to provide access from the interior of the building, for exhaust or for intake, to the atmosphere. The upper end 308 of the flexible tube 300 is folded over the upper end 418 of the conduit 410 to prevent water from passing through the gap between the outer surface 412 of the conduit and the opening 406 in the roof structure 400.

Figure 2A:
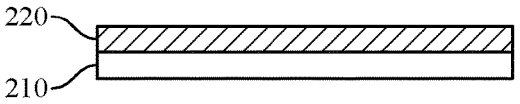
FIG. 2A is a cross-sectional illustration of the base portion of an exemplary roof flashing, wherein the water barrier is attached to the shaping material on one side.
Figure 2B:
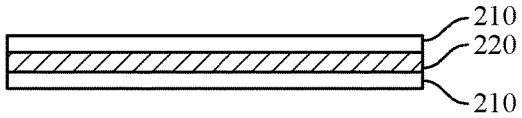
FIG. 2B is a cross-sectional illustration of the base portion of an exemplary roof flashing, wherein the water barrier is attached to the shaping material on two sides.
Figure 2C:
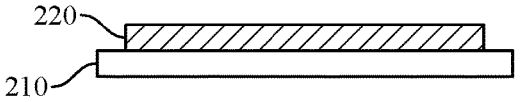
FIG. 2C is a cross-sectional illustration of the base portion of an exemplary roof flashing, wherein the water barrier is attached to the shaping material on one side and the shaping material does not extend to the edge of the water barrier.
Figure 2D:
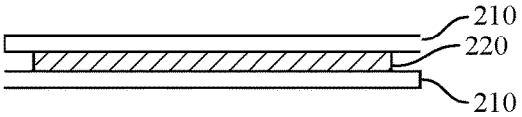
FIG. 2D is a cross-sectional illustration of the base portion of an exemplary roof flashing, wherein the water barrier is attached to the shaping material on two sides side and the shaping material does not extend to the edge of the water barrier.
Figure 2E:
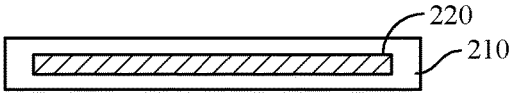
FIG. 2E is a cross-sectional illustration of the base portion of an exemplary roof flashing, wherein the shaping material is embedded within the water barrier.

Referring now to FIGS. 2A, 2B, 2C, 2D, and 2E, various configurations of the water barrier 210 and the shaping material 220 in the base 200 are shown in cross-sectional views. In each of these configurations, the water barrier 210 in the base 200 may be attached to the shaping material 220 in the base 200 by various techniques including, but not limited to, fastening, gluing, ultrasonic welding, heat sealing, over-molding, etc. Over-molding is the injection molding process where one material is molded onto a second material (substrate). If properly selected, the over-molded material will form a strong bond with the substrate that is maintained in the end-use environment. In FIG. 2A, the shaping material 220 is attached to the water barrier 210 on one side and extends to the edges of the water barrier 210. In FIG. 2B, the water barrier 210 is attached to both sides of the shaping material 220 and the shaping material 220 extends to the edge of the water barrier 210. The shaping material 220 in FIG. 2C is attached to the water barrier 210, like in FIG. 2A, but does not extend to the edges of the water barrier 210. The water barrier 210 in FIG. 2D is attached to both sides of the shaping material 220, like in FIG. 2B, but the shaping material 220 does not extend to the edges of the water barrier 210. In FIG. 2E, the shaping material 220 is fully embedded within the water barrier 210.

Figure 3A:
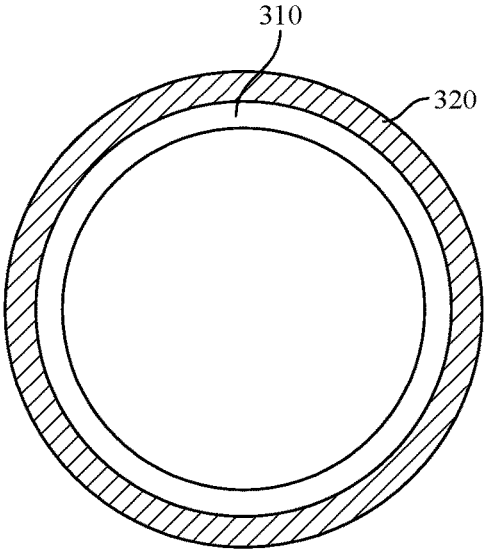
FIG. 3A is a cross-sectional illustration of the flexible tube portion of an exemplary roof flashing, wherein the water barrier is attached to one side of the shaping material.
Figure 3B:
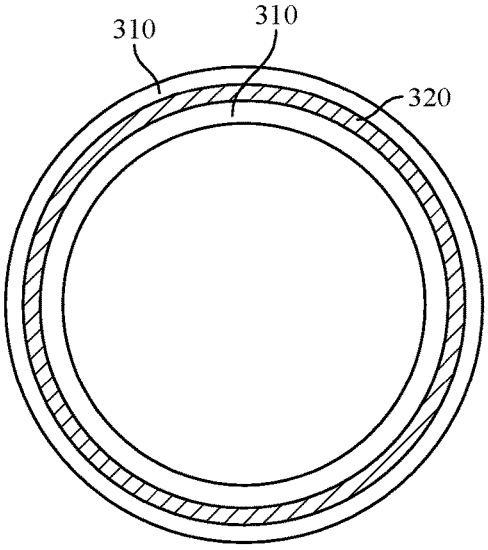
FIG. 3B is a cross-sectional illustration of the flexible tube portion of an exemplary roof flashing, wherein the shaping material is embedded within the water barrier.

Referring to FIGS. 3A and 3B, two configurations of the water barrier 310 and the shaping material 320 in the flexible tube 300 are shown in cross-sectional views. In each of these configurations, the water barrier 310 in the flexible tube 300 may be attached to the shaping material 320 in the flexible tube 300 by various techniques including, but not limited to, fastening, gluing, ultrasonic welding, heat sealing, over-molding, etc. In FIG. 3A, the shaping material 320 is attached to one side of the water barrier 310. In FIG. 3B, the shaping material 320 is embedded within the water barrier 310.

Figure 4A:
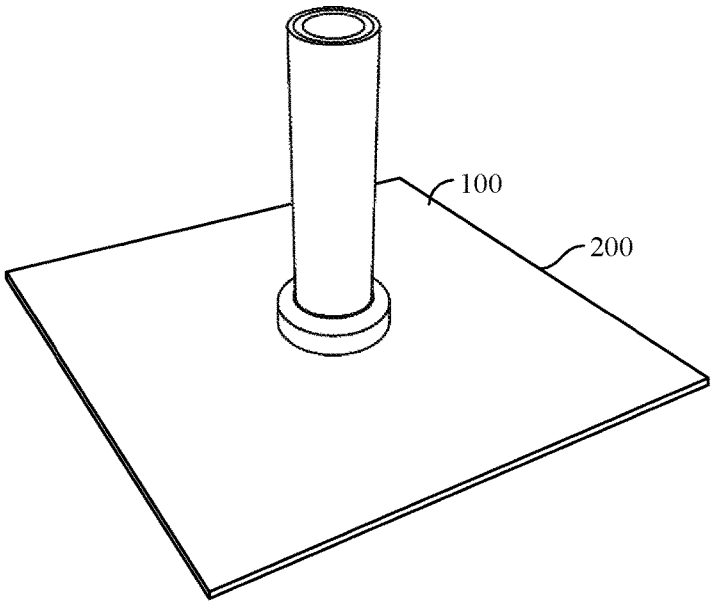
FIG. 4A is an illustration of an exemplary roof flashing with its base in an unmolded condition.
Figure 4B:
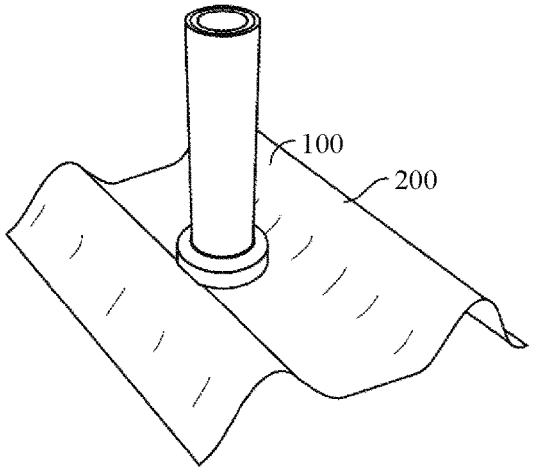
FIG. 4B is an illustration of an exemplary roof flashing with its base in a molded condition where the folds are parallel to the edge of the base.
Figure 4C:
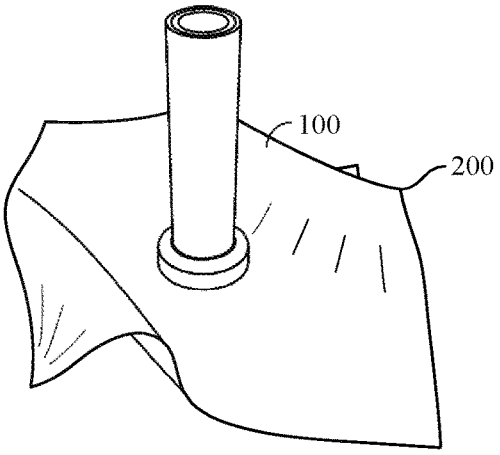
FIG. 4C is an illustration of an exemplary roof flashing with its base in a molded condition where the fold are parallel to the diagonal of the base.

Referring now to FIGS. 4A, 4B, and 4C, an exemplary embodiment of a roof flashing 100 is shown with the base 200 in various conditions. In FIG. 4A, the base 200 of the roof flashing 100 is in an unbent condition. In FIG. 4B, the base 200 of the roof flashing 100 is shown in a bent condition where the base 200 is bent in a direction that is parallel to an edge of the base 200. In FIG. 4C, the base 200 of the roof flashing 100 is shown in a bent condition where the base 200 is bent in along a diagonal of the base 200.

Figure 5A:
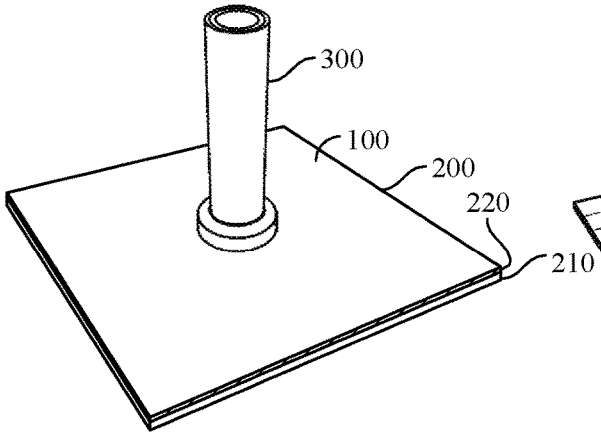
FIG. 5A is an illustration of an exemplary roof flashing wherein a uniform layer or sheet of metal is used as the shaping material.
Figure 5B:
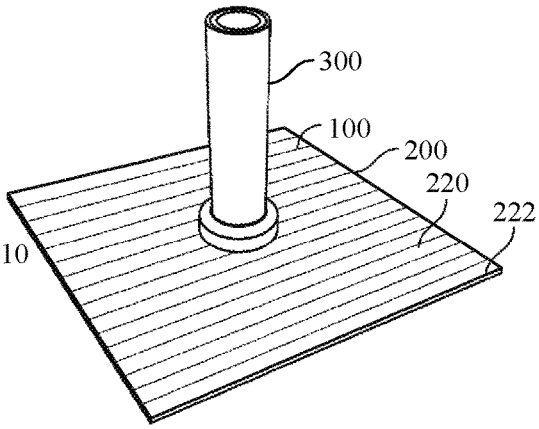
FIG. 5B is an illustration of an exemplary roof flashing wherein metal strips arranged parallel to each other are used as the shaping material.
Figure 5C:
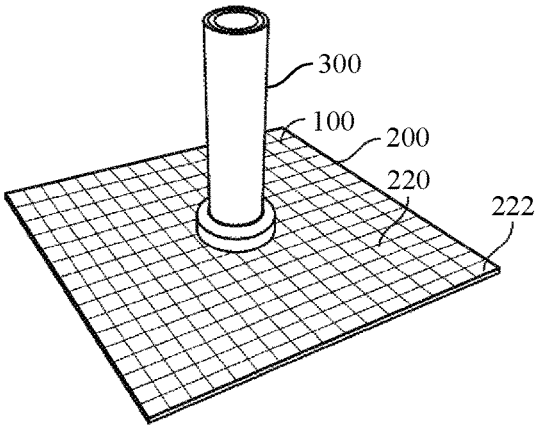
FIG. 5C is an illustration of an exemplary roof flashing wherein metal strips arranged in a mesh pattern are used as the shaping material.
Figure 5D:
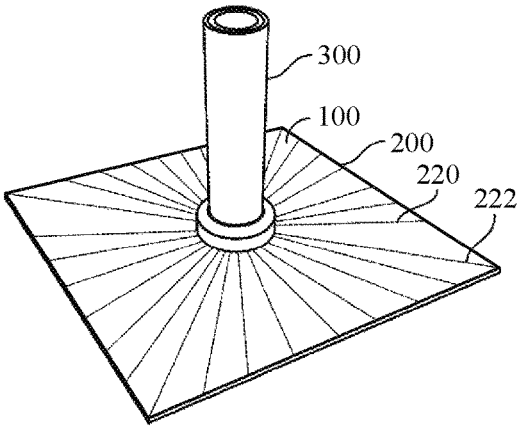
FIG. 5D is an illustration of an exemplary roof flashing wherein metal strips arranged in a radial pattern are used as the shaping material.
Figure 5E:
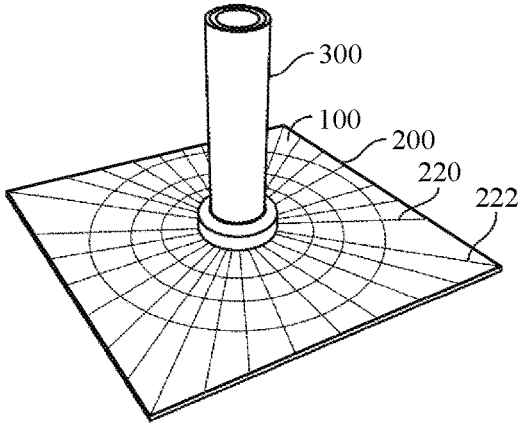
FIG. 5E is an illustration of an exemplary roof flashing wherein metal strips arranged in radial and concentric circle patterns are used as the shaping material.

Referring to FIGS. 5A, 5B, 5C, 5D, and 5E, exemplary embodiments of a roof flashing 100 are shown with different configurations of the shaping material 220 in the base 200. In FIG. 5A, a uniform metal layer or sheet is used as the shaping material 220. In FIGS. 5B, 5C, 5D, and 5E, metal strips 222 are used as the shaping material 220 in the base 200. In FIG. 5B, the metal strips 222 are arranged in substantially the same direction throughout the base 200. In FIG. 5C, the metal strips 222 are arranged in two different directions to create a mesh pattern. In FIG. 5D, the metal strips 222 are arranged in a pattern radiating out from the location of the flexible tube 300. In FIG. 5E, the same radial pattern from FIG. 5D can be seen, with other metal strips 222 arranged in concentric circles to create a radial mesh pattern.

Figure 6A:
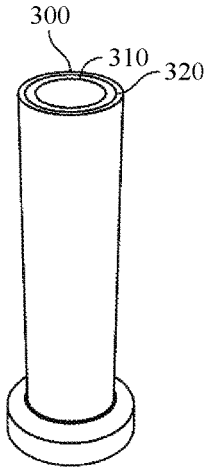
FIG. 6A is an illustration of the flexible tube portion of an exemplary roof flashing wherein a uniform layer or sheet of metal is used as the shaping material.
Figure 6B:
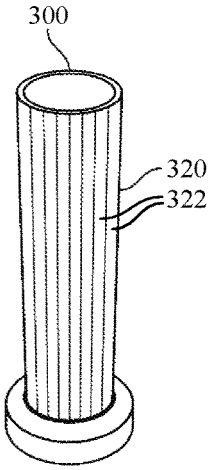
FIG. 6B is an illustration of the flexible tube portion of an exemplary roof flashing wherein metal strips arranged parallel to each other are used as the shaping material.
Figure 6C:
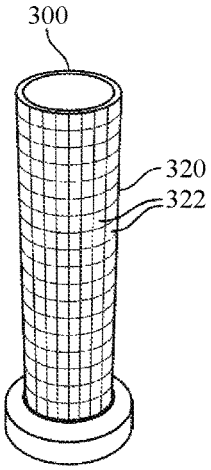
FIG. 6C is an illustration of the flexible tube portion of an exemplary roof flashing wherein metal strips arranged in a mesh pattern are used as the shaping material.
Figure 6D:
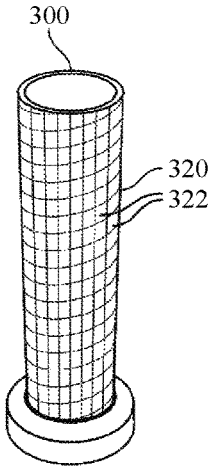
FIG. 6D is an illustration of the flexible tube portion of an exemplary roof flashing wherein metal strips arranged in a spiral mesh pattern are used as the shaping material.

Referring now to FIGS. 6A, 6B, 6C, and 6D, exemplary embodiments of a flexible tube 300 are shown with different configurations of the shaping material 320. In FIG. 6A, a uniform metal layer or sheet is used as the shaping material 320. In FIGS. 6B, 6C, and 6D, metal strips 322 are used as the shaping material 320. In FIG. 6B, the metal strips 322 are arranged in substantially the same direction throughout the flexible tube 300. In FIG. 6C, the metal strips 322 are arranged in two substantially perpendicular different directions to create a mesh pattern. In FIG. 6D, the metal strips 322 are arranged in two different directions to create a spiral mesh pattern.

Figure 7A:
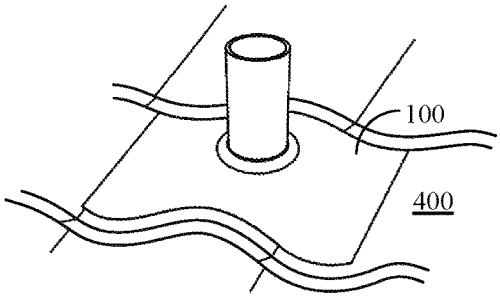
FIG. 7A is an illustration of an exemplary roof flashing assembled to a conduit protruding from a tile roof.
Figure 7B:
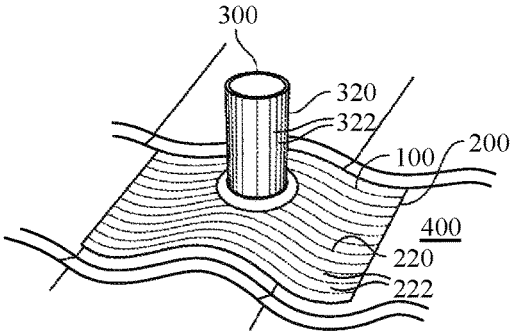
FIG. 7B is an illustration of an exemplary roof flashing assembled to a conduit protruding from a tile roof wherein metal strips are used as the shaping material.

Referring to FIG. 7A, an exemplary roof flashing 100 is shown installed on roof structure 400 covered in tiles. In FIG. 7B, an exemplary roof flashing 100 is shown installed on a roof structure 400 covered in tiles, wherein metal strips 222 are used as the shaping material 220 in the base 200 of the roof flashing 100, and metal strips 322 are used as the shaping material 320 in the flexible tube 300 of the roof flashing 100.

EXAMPLES

The following examples illustrate exemplary embodiments and features of various roof flashing encompassed by the general inventive concepts. The examples are given solely for the purpose of illustration and are not to be construed as limiting the present disclosure, as many variations thereof are possible and also encompassed by the general inventive concepts.

In order to more thoroughly describe this invention, the following working examples are provided. In these examples, the roof flashings made in accordance with this invention were made using the following exemplary materials. In Example 1, the water barrier is liquid silicone rubber (LSR) having the composition shown below.

Example 1: Liquid Silicone Rubber (LSR)

| Component | Amount (wt %) |
|---|---|
| Vinyl terminated polydimethylsiloxane | 60-75% |
| Hexamethyldisilane treated silica | 25-40% |
| Methyl hydrosiloxane-dimethyl siloxane copolymer | 2-5% |
| Platinum catalyst | 150-200 ppm |

In Example 2, the water barrier is solid silicone rubber or high temperature vulcanizing (HTV) rubber having the composition shown below.

Example 2: Solid Silicone Rubber or High Temperature Vulcanizing (HTV) Rubber

| Components | Amount (wt %) |
|---|---|
| Vinylmethylsiloxane-dimethyl siloxane copolymer | 60-75% |
| Fumed silica | 25-40% |
| Peroxide catalyst | 0.5-2.0% |

Both formulations (LSR and HTV) can be used as a moldable silicone for the water barrier. Other additives can be incorporated in formulation like heat stabilizers, colorants, and fire retardants.

In Examples 3-6, the shaping material is any one of the aluminum alloys having the compositions shown below. In Examples 3-6 below aluminum alloys were used to make an aluminum wire mesh.

| Aluminum Alloys | |
|---|---|
| Example 3 | 1100 series aluminum alloy which consist of 99 wt % pure aluminum |
| Example 4 | 3000 series aluminum alloyed with manganese |
| Example 5 | 5000 series aluminum alloyed with magnesium |
| Example 6 | 6000 series aluminum alloyed with magnesium and silicon |

The foregoing description of the preferred embodiments of the present invention has been presented for purposes of illustration and description. It is not intended to be exhaustive or to limit the invention to the precise form disclosed. Modifications or variations are possible in light of the above teachings. A roof flashing, a roof flashing in combination with a roof structure and a conduit, and a method of installing a roof flashing in accordance with the present invention may include any combination or sub-combination of the features or concepts disclosed by the present application.

The embodiments were chosen and described to illustrate the principles of the invention and its practical application. It is clear that modifications and variations are within the scope of the invention as determined by the appended claims. The preferred embodiments do not and are not intended to limit the ordinary meaning of the claims in their fair and broad interpretation in any way.

What is claimed is:

1. A roof flashing comprising:

a base including a first water barrier attached to a first metallic shaping material, wherein the first water barrier is made from a first elastomer, wherein the base is shapeable to match a contour of a roof structure;

a flexible tube including a second water barrier attached to a second metallic shaping material, wherein the second water barrier is made from a second elastomer, wherein the flexible tube comforms to a conduit extending from the roof structure, and wherein the flexible tube folds over an upper end of the conduit;

an opening through the base, wherein the flexible tube extends through the opening in the base; and wherein the base has a bottom surface that abuts a top surface of the roof structure at a point of intersection with the flexible tube.

2. The roof flashing of claim 1, wherein the first water barrier is over-molded onto the first metallic shaping material and wherein the second water barrier is over-molded onto the second metallic shaping material.

3. The roof flashing of claim 1, wherein the first water barrier is embedded in the first metallic shaping material and wherein the second water barrier is embedded in the second metallic shaping material.

4. The roof flashing of claim 1, wherein the roof flashing is lead-free.

5. The roof flashing of claim 1, wherein the first elastomer is a silicone rubber and wherein the second elastomer is a silicone rubber.

6. The roof flashing of claim 1, wherein the shaping material is an aluminum alloy selected from the group consisting of 99% pure aluminum, aluminum-manganese alloys, aluminum magnesium alloys, aluminum-magnesium-silicon alloys, and combinations thereof.

7. The roof flashing of claim 1, further including a joint sealingly connecting the flexible tube to the base.

8. The roof flashing of claim 1, wherein the first metallic shaping material is disposed between a top surface of the base and a bottom surface of the base, and wherein the second metallic shaping material is disposed between an inner surface of the flexible tube and an outer surface of the flexible tube.

9. The roof flashing of claim 1, wherein the first metallic shaping material is embedded within the first water barrier, and wherein the second metallic shaping material is embedded within the second water barrier.

10. The roof flashing of claim 1, wherein the first shaping material is comprised of a plurality of metal strips oriented in substantially the same direction.

11. The roof flashing of claim 1, wherein the second shaping material is comprised of a plurality of metal strips oriented in substantially the same direction.

12. The roof flashing of claim 1, wherein the first shaping material is comprised of a plurality of metal strips oriented in two or more directions.

13. The roof flashing of claim 1, wherein the second shaping material is comprised of a plurality of metal strips oriented in two or more directions.

14. A roof flashing in combination with a roof structure and a conduit extending from the roof structure, the roof flashing comprising:

a base including a first water barrier over-molded onto a first metallic shaping material, wherein the first water barrier is made from a first elastomer, wherein the base is shapeable to match a contour of the roof structure;

a flexible tube including a second water barrier over-molded onto a second metallic shaping material, wherein the second water barrier is made from a second elastomer, wherein the flexible tube conforms to the conduit extending from the roof structure, and wherein the flexible tube fold over an upper end of the conduit; and an opening through the base, wherein the flexible tube extends through the opening in the base; and wherein the base has a bottom surface that abuts a top surface of the roof structure at a point of intersection with the flexible tube.

15. The roof flashing of claim 14, wherein the roof flashing is lead-free.

16. The roof flashing of claim 14, wherein the first elastomer is a silicone rubber.

17. The roof flashing of claim 14, wherein the second elastomer is a silicone rubber.

18. The roof flashing of claim 14, further including a joint sealingly connecting the flexible tube to the base.

19. The roof flashing of claim 14, wherein the first elastomer and second elastomer comprise 60-75% by weight vinyl terminated polydimethylsiloxane, 25-40% by weight hexamethyldisilane treated silica, 2-5% by weight methyl hydrosiloxane-dimethyl siloxane copolymer, and 150-200 ppm platinum catalyst.

* * * * *